US007364252B2

(12) United States Patent
Asauchi

(10) Patent No.: US 7,364,252 B2
(45) Date of Patent: Apr. 29, 2008

(54) PRINTING APPARATUS

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/674,911

(22) Filed: Feb. 14, 2007

(65) Prior Publication Data

US 2007/0126770 A1 Jun. 7, 2007

Related U.S. Application Data

(63) Continuation of application No. PCT/JP2005/016201, filed on Aug. 30, 2005.

(30) Foreign Application Priority Data

Sep. 1, 2004 (JP) ..... 2004-254222

(51) Int. Cl.
*B41J 29/393* (2006.01)

(52) U.S. Cl. ..... 347/19; 347/14

(58) Field of Classification Search ..... 347/14, 347/19

See application file for complete search history.

(56) References Cited

U.S. PATENT DOCUMENTS

| | | | | |
|---|---|---|---|---|
| 4,374,386 | A * | 2/1983 | Bildstein et al. | 347/85 |
| 4,401,999 | A * | 8/1983 | Brown, Jr. | 347/142 |
| 4,710,784 | A * | 12/1987 | Nakayama | 347/15 |
| 5,711,619 | A | 1/1998 | Kaneko et al. | |
| 2003/0043216 | A1 | 3/2003 | Usui et al. | |

FOREIGN PATENT DOCUMENTS

| | | | |
|---|---|---|---|
| JP | 2-134014 | A | 5/1990 |
| JP | 3-227629 | A | 10/1990 |
| JP | 6-320818 | A | 11/1994 |
| JP | 8-90871 | A | 4/1996 |
| JP | 9-320750 | | 12/1997 |
| JP | 10-086357 | A | 4/1998 |
| JP | 10-166617 | A | 6/1998 |
| JP | 2001-147146 | A | 5/2001 |
| JP | 2002-331690 | A | 11/2002 |
| JP | 2003-305862 | A | 10/2003 |

OTHER PUBLICATIONS

English translation of Written Opinion from Int'l Patent Appln. PCT/JP2005/016201 (Mar. 29, 2007).
International Search Report from PCT Patent Appln. PCT/JP2005/016201 (Nov. 29, 2005).

* cited by examiner

*Primary Examiner*—Lamson Nguyen
(74) *Attorney, Agent, or Firm*—Stroock & Stroock & Lavan LLP

(57) ABSTRACT

Printing apparatus 20 comprises a contact detection terminal 101, a cartridge detection circuit M10*a*, a for-senor terminal 104 and a sensor driving circuit M20, wherein the terminal 101 contacts to detection terminal 116 of ink cartridge 70 when the ink cartridge 70 is attached thereto, wherein the circuit M10*a* detects contact or non-contact between the terminal 116 and the terminal 101, wherein the terminal 104 outputs high voltage, wherein the circuit M20 controls voltage outputted from terminal 104. The cartridge detection circuit M10*a* also has a function of shorting detector for detecting contact between the contact detection terminal 101 and the for-senor terminal 104. In the case that the shorting is detected, the sensor driving circuit M20 redeces or interrupts the voltage outputted from terminal 104.

9 Claims, 7 Drawing Sheets

PRINTING APPARATUS

CROSS-REFERENCE TO RELATED APPLICATIONS

This application is a continuation of copending international application no. PCT/JP2005/016201, filed on Aug. 30, 2005.

This application claims the priority of Japanese patent application no. 2004-254222, filed on Sep. 1, 2004, the contents of which are incorporated by reference herein.

TECHNICAL FIELD

The present invention relates to a printing apparatus, and specifically relates to the technique to detect whether a printing material container is attached thereto, or to detect a type of a printing material container.

BACKGROUND ART

A printing apparatus (for example, an ink jet printer) which a printing material container (for example, an ink cartridge) is attached to and executes printing is desired to be automatically capable of determining whether a printing material container is attached thereto. Also, A printing apparatus, for example, which plural types of printing material containers can be attached to and can print in accordance with the type of the printing material container is desired to be automatically capable of determining the type of the printing material container attached thereto. For example, known is the technique wherein the printing material container has a type-identifying mark indicating the type of the material container itself and the printing apparatus detect such type-identifying mark to determine the type of the material container.

However, above-mentioned technique has the risk that a circuit for detecting whether the printing material container is attached or the type of the printing material container may short with other circuit of the printing apparatus via contact point between the printing material container and the printing apparatus, for example, by the adhesion of conductive ink to the contact point. Especially, in the case the other circuit in the printing apparatus is a circuit which outputs high voltage (for example, a circuit driving the sensor for detecting the remaining ink level in the printing material container), such shorting may cause a trouble with the printing material container or the printing apparatus.

DISCLOSURE OF THE INVENTION

An object of the present invention, which is intended to address the problem noted above, is to reduce or prevent the trouble with the printing material container or the printing apparatus, which has a detection circuit for detecting whether the printing material container is attached or the type of the printing material container, wherein the trouble is caused by shorting between the detection circuit and other circuit of the printing apparatus.

A printing apparatus to which at least one printing material container is attachable, wherein the printing material container stores printing material and has a detection terminal is provided. The printing apparatus pertaining to the first aspect of the invention is characterized by comprising:

a contact detection terminal that contacts to the detection terminal of the printing material container when the printing material container is attached to the printing apparatus;

a contact detection circuit that detects contact or non-contact between the contact detection terminal and the detection terminal of the printing material container using a predetermined level of voltage;

a high voltage output terminal that outputs a high voltage higher than the predetermined level of voltage;

a shorting detector that detects a shorting between the contact detection terminal and the high voltage output terminal; and a high voltage circuit that controls a voltage outputted from the high voltage output terminal, wherein the high voltage circuit reduces or interrupts the voltage outputted from the high voltage output terminal when the shorting is detected.

The printing apparatus pertaining to the first aspect of the invention has the detector that detects the shorting between the contact detection terminal and the high voltage output terminal, and reduces or interrupts the voltage outputted from the high voltage output terminal when the shorting is detected. In the result, in the case that the shorting happens, it can reduce or prevent the trouble that the high voltage is applied to the contact detection circuit via the contact detection terminal and the high voltage output terminal. Therefore, it is possible to reduce or prevent the trouble with the printing apparatus caused by the shorting.

A second aspect of the invention provides a control method of a printing apparatus to which at least one printing material container is attachable, wherein the printing material container stores printing material and has a detection terminal, wherein the printing apparatus has a contact detection terminal that contacts to the detection terminal of the printing material container when the printing material container is attached to the printing apparatus and a high voltage output terminal that outputs a high voltage. The control method pertaining to the second aspect of the invention is characterized by comprising:

monitoring a shorting between the high voltage output terminal and the contact detection terminal;

outputting a voltage from the high voltage output terminal while monitoring the shorting; and reducing or interrupting the voltage outputted from the high voltage output terminal when the shorting is detected.

According to the control method pertaining to the second aspect of the invention, the printing apparatus outputs a voltage from the high voltage output terminal while monitoring the shorting, and reduces or interrupts the voltage outputted from the high voltage output terminal when the shorting is detected. Therefore, it is possible to reduce or prevent the trouble that the high voltage is applied to the contact detection circuit via the contact detection terminal and the high voltage output terminal, when the shorting happens.

The control method pertaining to the second aspect of the invention may also be actualized in a variety of aspects in a way similar to the printing apparatus pertaining to the first aspect of the invention.

BEST MODES OF CARRYING OUT THE INVENTION

Following, the printing apparatus of the present invention is described based on the embodiments with reference to drawings.

A. Embodiment

Figure 1:
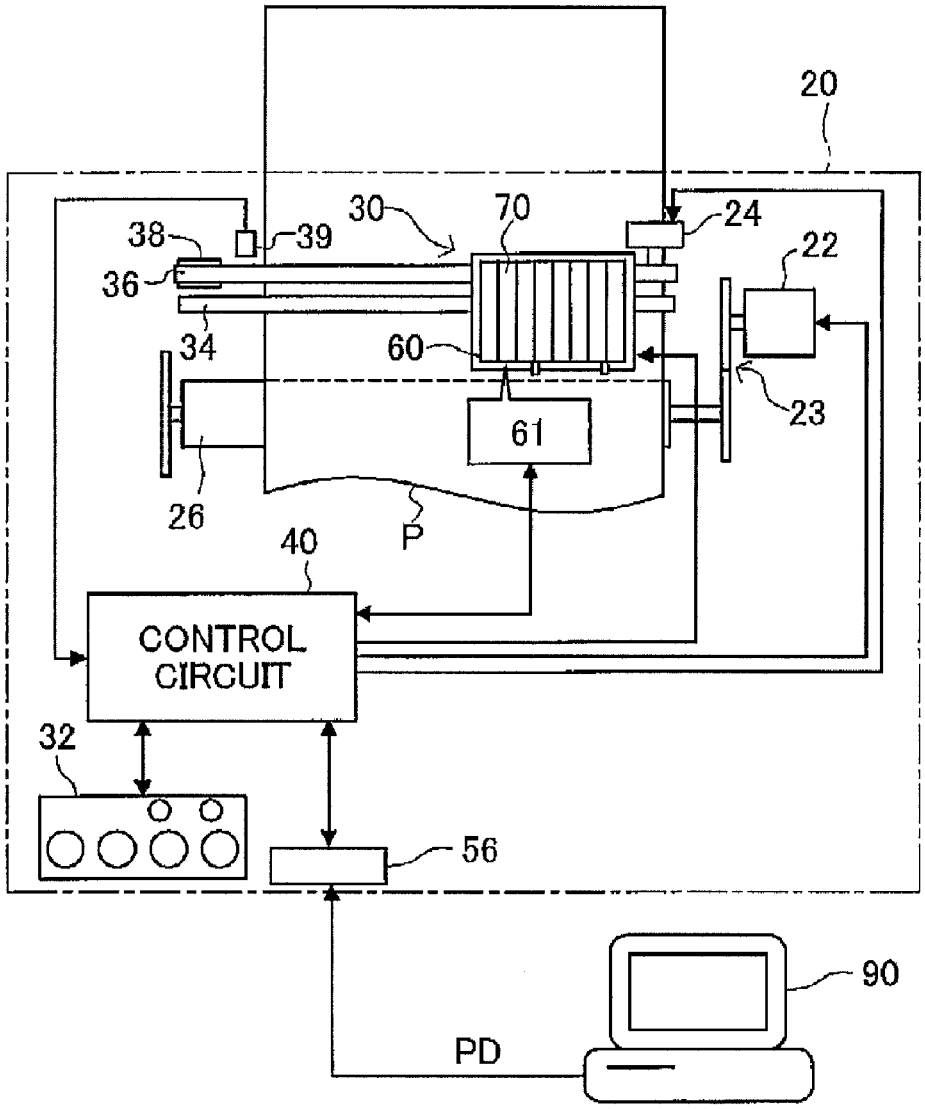
FIG. 1 schematically illustrates the construction of a printing apparatus 20 as an embodiment of this invention.

Construction of Printing Apparatus and Ink Cartridge 70:

FIG. 1 schematically illustrates the construction of a printing apparatus 20 as an embodiment of this invention. It includes a sub-scanning mechanism, a main scanning mechanism, a head driving mechanism, and a control circuit 40. The sub-scanning mechanism feeds the paper P in the sub-scanning direction by paper feed motor 22. The main scanning mechanism reciprocates the carriage 30 in the direction of the axis of a platen 26 (the main scanning direction) by the carriage motor 24. The head driving mechanism drives printing head unit 60 disposed on the carriage 30 to control ink ejection and dot formation. Control circuit 40 governs signal communication with these paper feed motor 22, carriage motor 24, printing head unit 60, and control panel 32. Control circuit 40 is connected to computer 90 via connector 56.

The sub-scanning mechanism for feeding the paper P includes gear train 23 to transmit rotation of the paper feed motor 22 to the platen 26. And the main scanning mechanism for reciprocating the carriage 30 has a sliding shaft 34 that is arranged in parallel with the axis of the platen 26 to hold the carriage 30 in a slidable manner, a pulley 38 that supports an endless drive belt 36 spanned between the carriage motor 24 and the pulley 38, and a position sensor 39 that detects the position of the origin of the carriage 30.

Figure 2:
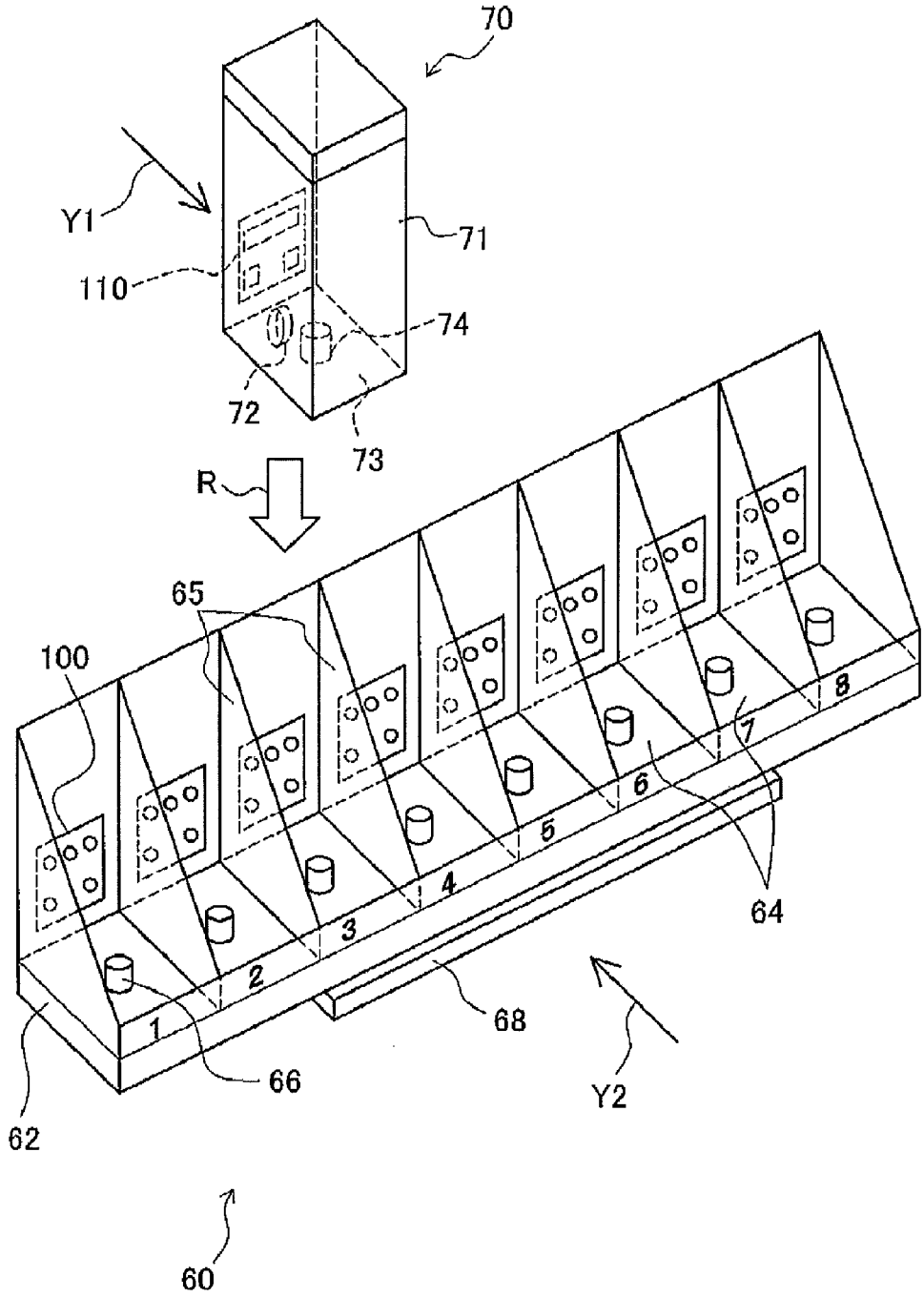
FIG. 2 shows perspective view of printing head unit 60 and ink cartridge 70 attached thereto.

FIG. 2 shows perspective view of printing head unit 60 and ink cartridge 70 attached thereto pertaining to this embodiment. The printing head unit 60 includes cartridge holder 62 to which the plurality of ink cartridge 70 (8 ink cartridge in this embodiment) are able to be attached, printing head 68, and cartridge process dedicated circuit 61 (display is omitted in FIG. 2) that is dedicated circuit to execute the process associated with ink cartridge 70.

The cartridge holder 62 includes guide 65 and same number of ink supply port 66 and terminal board 100 as the number of attachable ink cartridge. The guide 65 has a function to allow the ink cartridge 70 inserted in predetermined insertion direction R and not to allow it in other direction.

The ink supply port 66 is inserted into ink supply opening 74 described below of the ink cartridge 70 to supply the ink to the printing head 68, when the ink cartridge 70 is attached to the cartridge holder 62. On the terminal board 100, terminals corresponding to some kinds of terminals arranged on circuit board 110 described below of the ink cartridge 70 are disposed.

Next, the ink cartridge 70 is described. As shown in FIG. 2, the ink cartridge 70 is a container that contains one kind of the ink as the printing material. The ink cartridge 70 includes a body 71 that contain the ink therein, a ink supply opening 74 to supply the ink to the printing apparatus 20, a sensor 72 that is used for detection of remaining ink level, and a circuit board 110 on which some kinds of terminals described later are disposed. The ink supply opening 74 is placed on the base of the body 71 and the sensor 72 is placed on the lateral of the body 71. A piezoelectric element is used for the sensor 72 in this embodiment.

The circuit board 110 is mounted on the outer surface of the body 71. Various terminals are accordingly arranged on the surface of the body 71 as described later. The circuit board 110 is located in an approximately ½ area of the outer surface (in a lower half area in this embodiment) in the insertion direction, although it may be located in an approximately ⅓ or ¼ area of the outer surface in the insertion direction. The circuit board 110 has a variety of terminals corresponding to the terminals disposed on the terminal board 100 on the cartridge holder 62 described above.

The circuit board 110 are placed to face the terminal board 100 in attachment of the ink cartridge 70 to the cartridge holder 62. Attachment of the ink cartridge 70 to the cartridge holder 62 causes the terminals on the circuit board 110 on the ink cartridge 70 to come into contact with the terminals on the terminal board 100 on the cartridge holder 62. In the specification hereof, a terminal corresponding to a certain terminal represents the terminal in contact with the certain terminal in attachment of the ink cartridge 70 to the cartridge holder 62. This only regards the terminal in contact with the certain terminal in the normal state and does not include any terminal accidentally in contact with the certain terminal due to improper attachment or ink adhesion.

Figure 3:
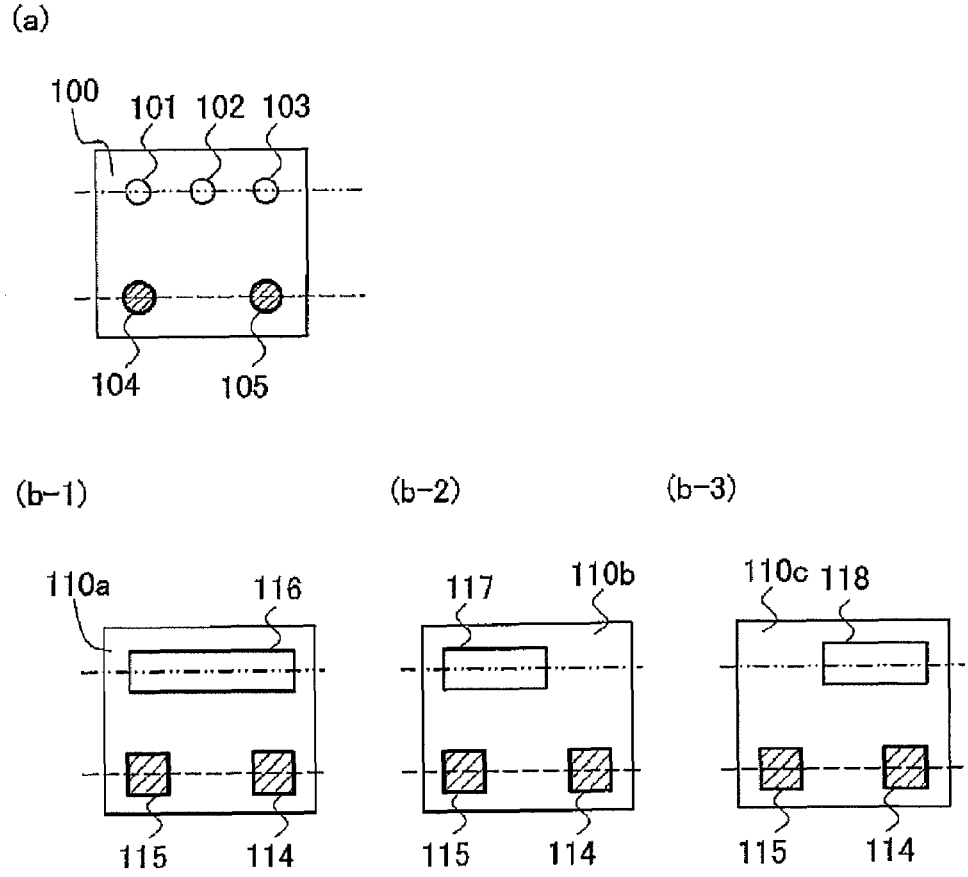
FIG. 3 shows a schematic of terminals on terminal board 100 and circuit board 110 in the embodiment.

FIG. 3 schematically illustrates the arrangement of terminals on the terminal board 100 on the cartridge holder 62 and the circuit board 110 on the ink cartridge 70 in this embodiment. FIG. 3(*a*) shows a terminal array on the terminal board 100 on the cartridge holder 62 seen in the direction of an arrow Y2 in FIG. 2. FIG. 3(*b*) shows a terminal array on the circuit board 110 on the ink cartridge 70 seen in the direction of an arrow Y1 in FIG. 2.

The description first regards the terminals on the terminal board 100 on the cartridge holder 62. The terminal board 100 has three terminals 101 to 103 for cartridge detection circuit M10 described later and two terminals 104, 105 for sensor driving circuit M20 described later. The three cartridge detection circuit terminals 101 to 103 are aligned on a line as shown by the two-dot chain line in FIG. 3(*a*). Among the three terminals 101 to 103, terminal 101 and terminal 103 are terminals for detecting presence or absence of a contact with terminal 116 to 118 on the ink cartridge 70 described later. Hereinafter, terminal 101 and terminal 103 are referred to as contact detection terminals 101,103. Among the three terminals 101 to 103, terminal 102 is a ground terminal.

The two terminals 104 and 105 are aligned on a line different from the line formed by three terminals 101 to 103 as shown by the broken line in FIG. 3(*a*). Among the two terminals 104 and 105, terminal 104 is a terminal that outputs a driving voltage to the sensor 72 by control of the sensor driving circuit M20 described later, and terminal 105 is a ground terminal. Hereinafter, terminal 104 is referred to as for-sensor terminals 104.

The description then regards the terminal arrays on the circuit board 110 on the ink cartridge 70. There are three different structures 110*a* to 110*c* of the circuit board 110 as shown in FIGS. 3(*b*-1) to 3(*b*-3). A predetermined structure of the circuit board 110 according to ink type or ink quantity is mounted on each ink cartridge 70. For example, depending on the quantity of ink contained in the ink cartridge 70, board 110*a* shown in FIG. 3(*b*-1) could be disposed on an L size cartridge containing a large quantity of ink; board 110*b* shown in FIG. 3(*b*-2) could be disposed on an M size cartridge containing a standard quantity of ink; and board 110*c* shown in FIG. 3(*b*-3) could be disposed on an S size cartridge containing a small quantity of ink. Hereinafter, L size cartridge is referred to as Type A cartridge, M size cartridge is referred to as Type B cartridge, S size cartridge is referred to as Type C cartridge.

The circuit board 110*a* has a oblong figure terminal 116 corresponding to three terminals 101 to 103 on the terminal board 100 and two terminals 114 and 115 that respectively correspond to the two terminals 104 and 105 on the terminal board 100. The oblong figure terminal 116 is a terminal that electrically interconnects the three terminals 101 to 103.

The circuit board 110*b* has, as substitute for terminal 116 of the circuit board 110*a*, a oblong figure terminal 117 corresponding to two terminals 102 and 103 among three terminals 101 to 103. The circuit board 110*c* has, as substitute for terminal 116 of the circuit board 110*a*, a oblong figure terminal 118 corresponding to two terminals 101 and 102 among three terminals 101 to 103. Other structures of the circuit boards 110*b* and 110*c* are same as that of the circuit boards 110*a*.

Terminals 116 to 118 of the circuit boards 110*a* to 110*c* are terminals which contact to the contact detection terminals 101,103, wherein the contact is detected. Hereinafter, terminals 116 to 118 are referred to as the detection terminals 116 to 118. Terminal 114 of the circuit boards 110*a* to 110*c* is a terminal that is connected to one electrode of the sensor 72 and contacts to for-sensor terminal 104 described above. Hereinafter, terminal 114 is referred to as the sensor terminal 114. Terminal 115 of the circuit boards 110*a* to 110*c* is a terminal that is connected to the other electrode of the sensor 72 and contacts to the ground terminal 105 described above.

Figure 4:
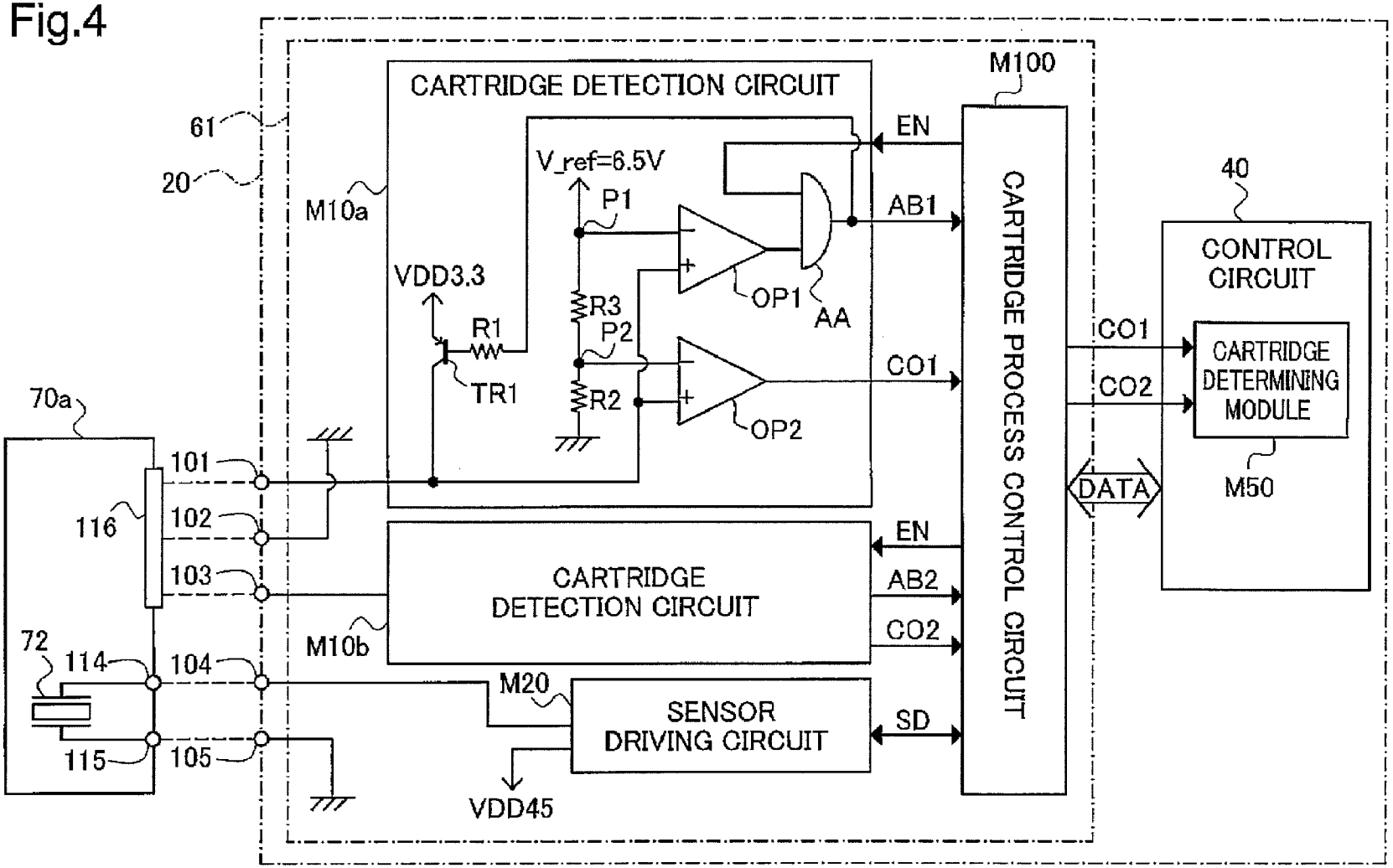
FIG. 4 shows a schematic of electrical construction of cartridge process dedicated circuit 61.

FIG. 4 shows a schematic of electrical construction of cartridge process dedicated circuit 61. For the convenience of explanation, FIG. 4 also shows electrical construction of ink cartridge 70 on which the circuit board 110*a* is disposed. FIG. 4 shows only the construction corresponding to one ink cartridge 70. With reference to FIG. 4, detailed description of electrical construction of cartridge process dedicated circuit 61 is provided.

The process dedicated circuit 61 is driven using relatively low voltage (3.3V). The cartridge detection circuit M10*a* has a cartridge detection function for detecting whether there is contact between the contact detection terminal 101 and the detection terminal 116 (FIG. 3(*b*-1)) or the detection terminal 118 (FIG. 3(*b*-3)) of the ink cartridge 70 described above, and a short detection function for detecting shorting of the contact detection terminal 101 to the for-sensor terminal 104 which may outputs high voltage.

To describe in more specific terms, the cartridge detection circuit M10*a* has a reference voltage V_ref1 applied to one end of two series-connected resistors R3, R4, with the other end being grounded, thereby maintaining the potential at point P1 and P2 in FIG. 4 at V_ref1 and V_ref2, respectively. Herein V_ref1 shall be termed the short detection voltage, and V_ref2 shall be termed the cartridge detection voltage. In this embodiment, the short detection voltage V_ref1 is set to 6.5 V, and the cartridge detection voltage V_ref2 is set to 2.5 V. These values are established by means of the circuits, and are not limited to the values given herein.

As shown in FIG. 4, the short detection voltage V_ref1 (6.5 V) is input to the negative input pin of a first Op-Amp OP1, while the cartridge detection voltage V_ref2 (2.5 V) is input to the negative input pin of a second Op-Amp OP2. The potential of the contact detection terminal 101 is input to the positive input pins of the first Op-Amp OP1 and the second Op-Amp OP2. These two Op-Amps function as a comparator, outputting a High signal when the potential input to the negative input pin is higher than the potential input to the positive input pin, and conversely outputting a Low signal when the potential input to the negative input pin is lower than the potential input to the positive input pin.

As depicted in FIG. 4, the contact detection terminal 101 is connected to a 3.3 V power supply VDD 3.3 via a transistor TR1. By means of this arrangement, if the contact detection terminal 101 is free e.g. there is no contact with the contact detection terminal 101, the potential of the contact detection terminal 101 will be set at about 3 V. When the ink cartridge 70, to which the circuit board 110*a* or 110*c* is mounted, is attached, the contact detection terminal 101 comes into contact with the detection terminal 116 or 118. When the contact detection terminal 101 contacts to the detection terminal 116 or 118 (herein referred to as being in contact), the contact detection terminal 101 is electrically continuous with the ground terminal 102, and the potential of the contact detection terminal 101 drops to 0 V.

Consequently, with the contact detection terminal 101 free, a High signal from the second Op-Amp OP2 is output as the cartridge detection signal CO1. With the contact detection terminal 101 in contact, a Low signal from the second Op-Amp OP2 is output as the cartridge detection signal CO1.

On the other hand, if the contact detection terminal 101 is shorted to the adjacent for-sensor terminal 104, there are instances in which the sensor driving voltage (45 V max) will be applied to the contact detection terminal 101. As shown in FIG. 4, when voltage greater than the short detection voltage V_ref1 (6.5 V) is applied to the contact detection terminal 101 due to shorting, a High signal from the Op-Amp OP1 will be output to an AND circuit AA.

As shown in FIG. 4, a short detection enable signal EN is input from the cartridge process control circuit M100 to the other input pin of the AND circuit AA. As a result, only during the time interval that a High signal is input as the short detection enable signal EN, the cartridge detection circuit M10*a* outputs the High signal from the Op-Amp OP1 as a short detection signal AB1. That is, execution of the short detection function of the cartridge detection circuit M10*a* is controlled by means of the short detection enable signal EN from the cartridge process control circuit M100. The short detection signal AB1 from the AND circuit AA is output to the cartridge process control circuit M100, as well as being output to the base pin of the transistor TR1 via resistance R1. As a result, by means of the transistor TR1 it is possible to prevent high voltage from being applied to the power supply VDD 3.3 via the contact detection terminal 101 when a short is detected (when the short detection signal AB1 is HI).

The other cartridge detection circuit M10*b* has a cartridge detection function for detecting whether there is contact between the other contact detection terminal 103 and the detection terminal 116 (FIG. 3(*b*-1)) or the detection terminal 117 (FIG. 3(*b*-2)) of ink cartridge 70, and a short detection function for detecting shorting of the other contact detection terminal 103 to the for-sensor terminal 104 which may output high voltage. Since the other cartridge detection circuit M10*b* has the same arrangement as the cartridge detection circuit M10*a*, a detailed illustration and description need not be provided here. Hereinafter, the cartridge detection signal output by the other cartridge detection circuit M10*b* shall be denoted as CS2, and the short detection signal as AB2.

The sensor driving circuit M20 is a circuit, in accordance with instruction from the cartridge process control circuit M100, to control the voltage output from the for-sensor terminal 104 to make the sensor 72 detect the remaining ink level. The sensor driving circuit M20 is composed of a logic circuit for example, but need not be described in detail herein.

The cartridge process control circuit M100 controls the cartridge process dedicated circuit 61 as a whole and exchanges the signals (for example, data signals and instruction signals) with the controller 40 which makes entire control of the printing apparatus 20. Especially, the cartridge process control circuit M100, in accordance with instruction from the controller 40, makes the sensor driving circuit M20 to detect the remaining ink level and outputs data of detection results to the controller 40. The cartridge process control circuit M100 also outputs the received cartridge detection signal CO1, CO2 to the controller 40. Furthermore, the cartridge process control circuit M100, in accordance with instruction of the controller 40, outputs the High signals as the short detection enable signal EN to the cartridge detection circuits M10*a*, M10*b* to make them to detect the shorting described previously. Receiving the short detection signal AB1, AB2 from the cartridge detection circuits M10*a*, M10*b*, the cartridge process control circuit M100 instructs the sensor driving circuit M20 to reduce or interrupt the voltage outputted from the for-sensor terminal 104. The cartridge process control circuit M100 may be composed of a logic circuit, or of a general-purpose processor.

An arrangement of the cartridge process dedicated circuit 61 corresponding to a single ink cartridge 70 has been described above. In the embodiment, since eight ink cartridges 70 are attached, two cartridge detection circuits M10*a*, M10*b* are provided for each ink cartridge 70 i.e. sixteen cartridge detection circuits in total are provided. While only a single sensor driving circuit M20 is provided, and a single sensor driving circuit M20 is connectable to each of the sensors 72 of the eight ink cartridges 70 by means of a switch (not shown). The cartridge process control circuit M100 is a single circuit responsible for processes relating to the eight ink cartridges.

The controller 40 is a computer of known design comprising a central processing unit (CPU), a read-only memory (ROM), and a random access memory (RAM). The controller 40 has cartridge determining module M50 together with various functions to control the entire printing apparatus. On the basis of the cartridge detection signals CO1, CO2 received from the cartridge process dedicated circuit 61, the cartridge determining module M50 determines whether the ink cartridge 70 is attached and the type of the ink cartridge 70 attached to the printing apparatus 20.

Operation of the Printing Apparatus

The concrete operation of the printing apparatus 20 pertaining to this embodiment will be described.

Cartridge Determination Process

Figure 5:
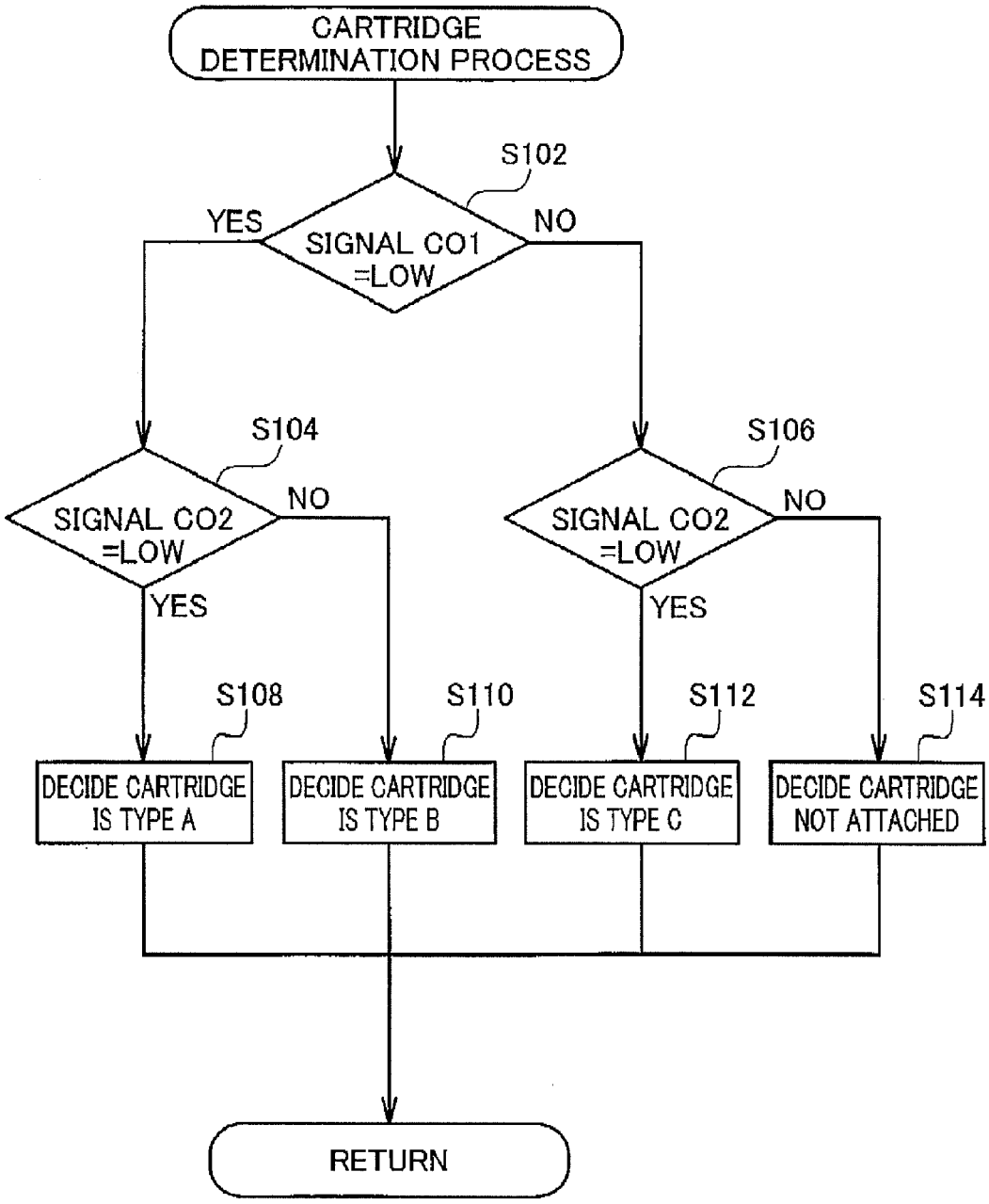
FIG. 5 is a flowchart showing the processing routine of the cartridge determination process.

FIG. 5 is a flowchart showing the processing routine of the cartridge determination process executed by the controller 40. The controller 40 constantly receives the cartridge detection signals CO1, CO2 received from the cartridge process dedicated circuit 61 for each of the eight attachment locations of the holder 62, and using these signals executes the cartridge determination process for each of the attachment locations.

When the controller 40 initiates the cartridge determination process for a selected attachment location, the controller 40 first ascertains whether the cartridge detection signal CO1 in the selected attachment location is a Low signal, i.e. whether the contact detection terminal 101 contacts to the detection terminal 116 or 118 (Step S102). Next, the controller 40 ascertains whether the cartridge detection signal CO2 in the selected attachment location is a Low signal, i.e. whether the contact detection terminal 103 contacts to the detection terminal 116 or 117 (Step S104 or S106). If as a result the cartridge detection signals CO1 and CO2 are both Low signals (Step S102: YES and Step S104: YES), the controller 40 decides that the ink cartridge 70 attached to the selected attachment location is Type A cartridge (L size).

Similarly, the controller 40, in the event that the cartridge detection signal CO1 is a Low signal and the cartridge detection signal CO2 is a High signal (Step S102: YES and Step S104: NO), decides that the ink cartridge is Type B cartridge (M size); or in the event that the cartridge detection signal CO1 is a High signal and the cartridge detection signal CO2 is a Low signal (Step S102: NO and Step S106: YES), decides that the ink cartridge is Type C cartridge (S size) described above.

In the event that both the cartridge detection signals CO1 and CO2 are High signals (Step S102: NO and Step S104: NO), the controller 40 decides that no cartridge is attached to the selected attachment location. In this way, the controller 40 determines whether an ink cartridge 70 is attached, and if so what type, for each of the eight attachment locations. As a result, the controller 40 can recognize the size of the ink cartridge attached to the printing apparatus 20, and, for example, can set to the proper timing or time cycle to detect the remaining ink level according to the size of the ink cartridge.

Remaining Ink Level Detection Process

Figure 6:
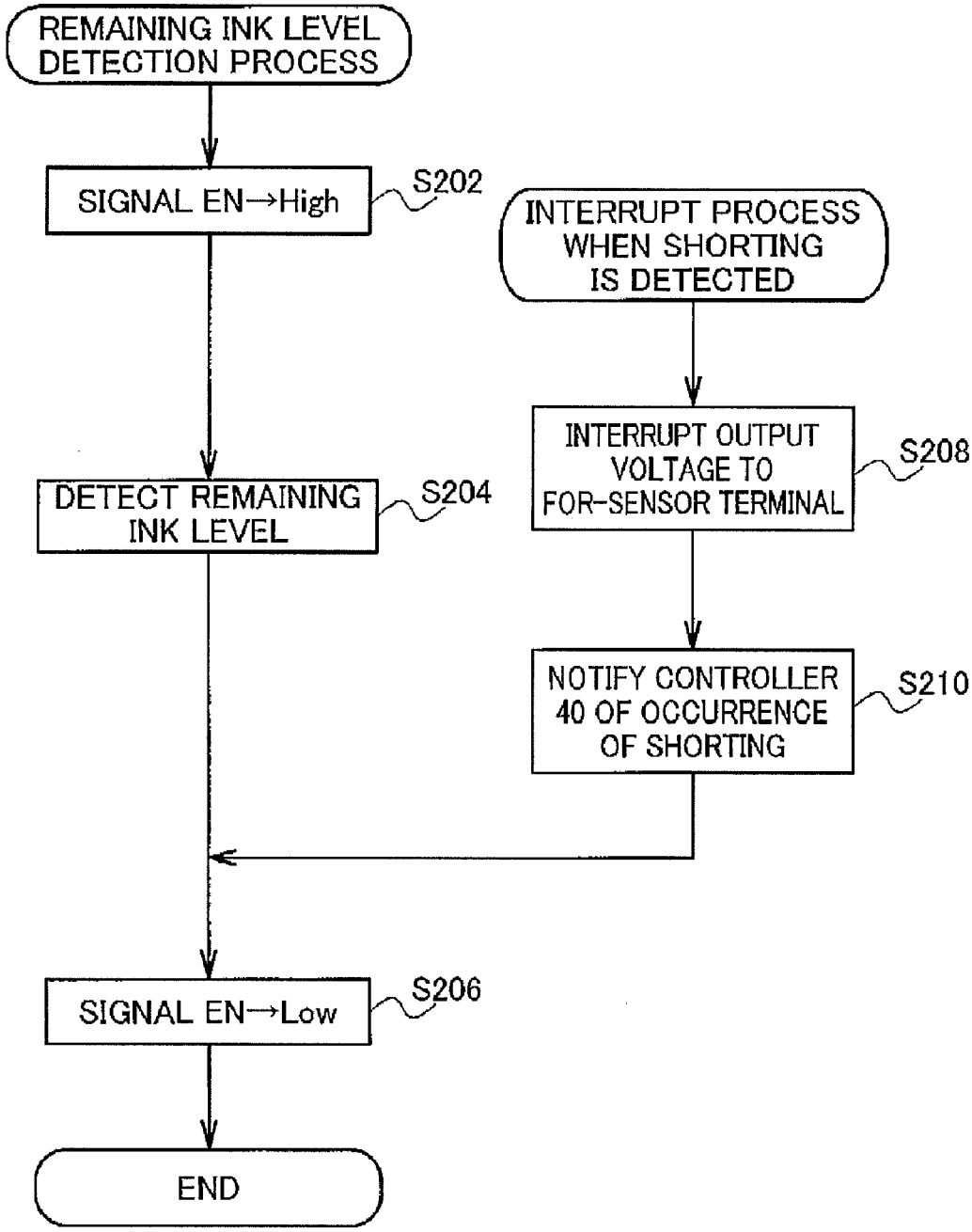
FIG. 6 is a flowchart showing the processing routine of the remaining ink level detection process.
Figure 7:
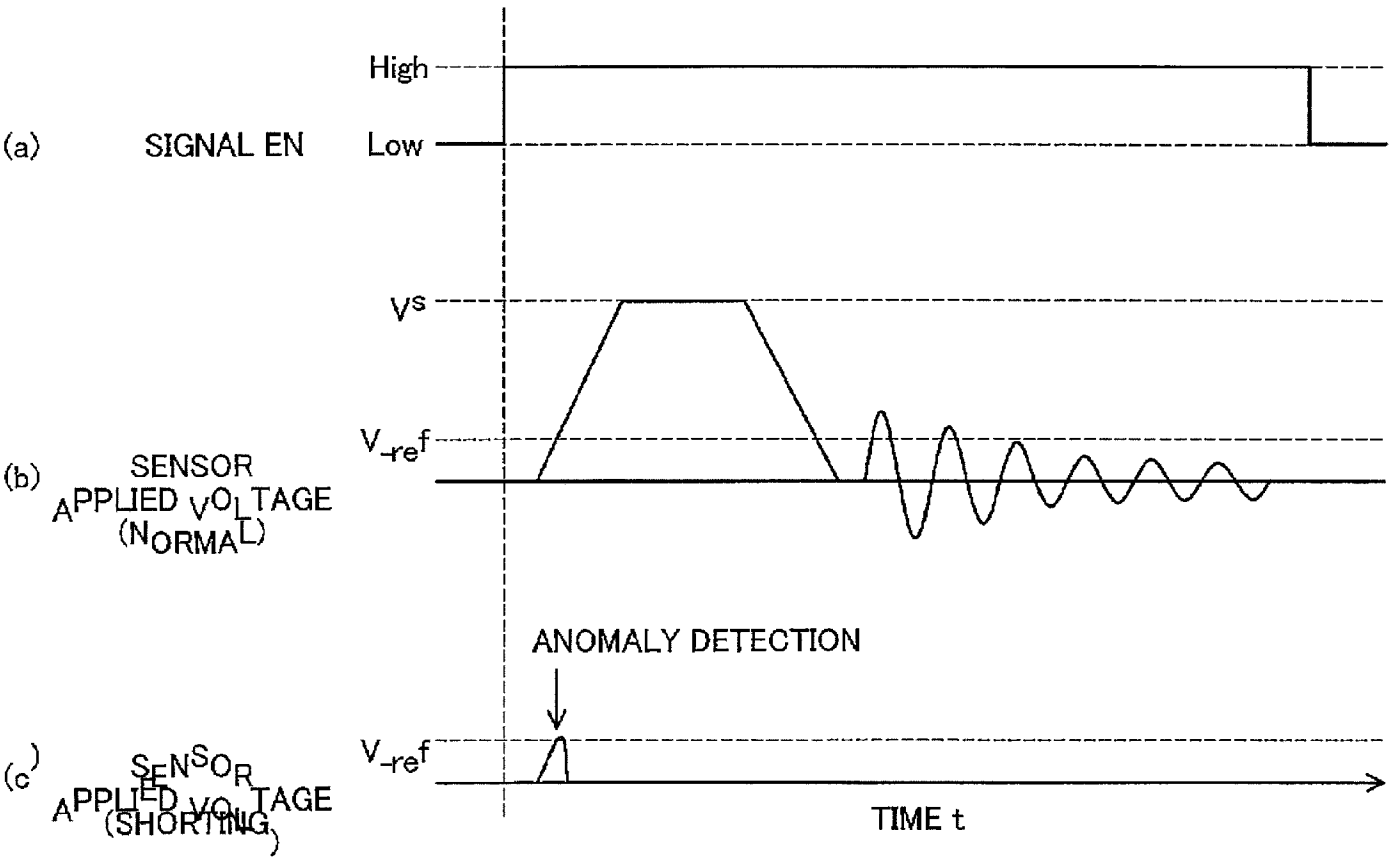
FIG. 7 shows schematics of temporal change in the signal EN and sensor applied voltage during execution of the remaining ink level detection process.

FIG. 6 is a flowchart showing the processing routine of the remaining ink level detection process executed by the cartridge process control circuit M100 of the cartridge process dedicated circuit 61. FIG. 7 shows schematics of temporal change in the short detection enable signal EN and sensor applied voltage which is a voltage being applied to the sensor 72 during execution of the remaining ink level detection process.

Receiving the instruction for detection of the remaining ink level and the attachment location to be detected, the control circuit M100 first sets to High the short detection enable signal EN to all of the cartridge detection circuits M10*a*, M10*b* (Step S202). As a result, the short detection function is enabled in all of the cartridge detection circuits M10*a*, M10*b*, and if voltage above the reference voltage V_ref1 (6.5 V) is applied to the aforementioned contact detection terminal 101 or 103 they are able to output High signals as the short detection signals AB1, AB2. In other words, a state in which the short detection enable signal EN are High signals is a state in which shorting of the contact detection terminal 101 or 103 to the for-sensor terminal 104 is monitored.

Next, the control circuit M100 instructs the sensor driving circuit M20 to output driving voltage from the for-sensor terminal 104 to the sensor 72 to detect the remaining ink level (Step S204). To describe in more specific terms, when the sensor driving circuit M20 receives an instruction signal from the control circuit M100, the sensor driving circuit M20 outputs driving voltage from the for-sensor terminal 104, the driving voltage being applied to the piezoelectric element which constitutes the sensor 72 of the ink cartridge 70, charging the piezoelectric element and causing it to distort by means of the inverse piezoelectric effect. The sensor driving circuit M20 subsequently drops the applied voltage, whereupon the charge built up in the piezoelectric element is discharged, causing the piezoelectric element to vibrate. Via the for-sensor terminal 104 and the sensor terminal 114, the sensor driving circuit M20 detects the voltage produced by the piezoelectric effect as a result of vibration of the piezoelectric element, and by measuring the vibration frequency thereof detects the remaining ink level. Specifically, this vibration frequency represents the characteristic frequency of the surrounding structures (the housing 71 and ink) that vibrate together with the piezoelectric element, and changes depending on the amount of ink remaining within the ink cartridge 70, so the remaining ink level can be detected by measuring this vibration frequency. The sensor driving circuit M20 outputs the detected result to the control circuit M100.

When the control circuit M100 receives the detected result from the sensor driving circuit M20, the control circuit M100 brings the short detection enable signal EN, which was previously set to a High signal in Step S202, back to a Low signal (Step S206), and terminates the process. In this process, the interval that the remaining ink level is being detected is a state in which the short detection enable signal EN is set to a High signal to enable short detection. In other words, remaining ink level is detected while the occurrence of shorting is being monitored by the cartridge detection circuits M10*a*, M10*b*.

Process when Shorting is Detected

The process carried out in the event that, during execution of detection of the remaining ink level (Step S204), the control circuit M100 receives a High signal as the short detection signal AB1 or AB2, e.g. shorting is detected shall be described here. In FIG. 6, a flowchart of the interrupt processing routine when shorting is detected is shown as well. When the contact detection terminal 101 shorts to the for-sensor terminal 104, the voltage outputted from for-sensor terminal 104 will be applied to the contact detection terminal 101. Thereupon, since the short detection enable signal EN is currently set to High, at the instant that the voltage outputted from for-sensor terminal 104 goes above the short detection voltage V_ref1 (6.5 V), a High signal will be output as the short detection signals AB1 from the cartridge detection circuit M10*a*. When the control circuit M100 receives this short detection signal AB1, the control circuit M100 suspends detection of remaining ink level, and executes the interrupt processing when shorting is detected. When the contact detection terminal 103 shorts to the for-sensor terminal 104, the control circuit M100 executes same process.

The scenario of shorting between the contact detection terminal 101 and the for-senor terminal 104 may include these terminals are bridged by the adhesion of conductive ink drop or dew condensation water drop, or by trapping electrically conducting object, for example, paper clip. Such bridging as described above may cause shorting between the ink cartridge-side corresponding terminals such as terminal 116 or 117 and terminal 114. When such ink cartridge 70 is attached to the cartridge holder 62, the shorting between the contact detection terminal 101 or 103 and the for-senor terminal 104 may be caused.

When the interrupt processing is initiated, the control circuit M100 immediately instructs the sensor driving circuit M20 to suspend the output of the voltage from the for-sensor terminal 104 (Step S208).

Next, the control circuit M100 reports the occurrence of the shorting described above (Step S210) and, without carrying out remaining ink level detection process to its conclusion, brings the short detection enable signal EN back to a Low signal (Step S206) to terminate the process. For example, the main control circuit 40 received the report of the shorting may take some countermeasure, such as notifying the user of the shorting.

FIG. 7 shows schematics of temporal change in the short detection enable signal EN and sensor applied voltage which is a voltage being applied to the sensor 72 during execution of the remaining ink level detection process. FIG. 7(*a*) shows change of the detection enable signal EN through time. FIG. 7(*b*) shows sensor applied voltage in the event that neither the contact detection terminal 101 nor 103 is shorting to the for-sensor terminal 104, so that the remaining ink level detection process is being executed normally. FIG. 7(*c*) shows sensor applied voltage in the event that the contact detection terminal 101 or 103 is shorting to the for-sensor terminal 104.

As depicted in FIG. 7(*a*), during execution of the remaining ink level detection process, the detection enable signal EN is a High signal. As shown in FIG. 7(*b*), in the normal state (no shorting), after high voltage Vs has been applied to the sensor 72, the applied voltage drops, and subsequently vibration voltage is produced through the piezoelectric effect. In the embodiment, Vs is set at 36 V.

As shown in FIG. 7(*c*), on the other hand, in the abnormal state (shorting), the sensor applied voltage drops at the instant that it goes above the short detection voltage V_ref1 (6.5 V). This is due to the fact that, at the instant that the sensor applied voltage goes above the short detection voltage V_ref1 (6.5 V), a High signal is output as the short detection signal AB1 or AB2 from the cartridge detection circuit M10*a* or M10*b* to the control circuit M100, and the control circuit M100 receiving this signal immediately drops the voltage outputted from the for-sensor terminal 104.

The printing apparatus 20 pertaining to this embodiment, which constituted as described above, has the cartridge detection circuits M10*a*, M10*b* as the function of shorting detector, whereby the printing apparatus 20 is capable of detecting shorting between the contact detection terminals 101, 103 and the for-senor terminal 104. In the case that the shorting is detected, the sensor driving circuit M20 immediately interrupts the voltage applied to the sensor 72. As a result, the trouble that the high voltage outputted from the for-senor terminal 104 is applied to the cartridge detection circuits M10*a*, M10*b* may be reduced or prevented. Therefore, the single sensor driving circuit M20 may avoid damage to the cartridge detection circuits M10*a* from above-mentioned shorting.

Furthermore, the cartridge detection circuits M10*a*, M10*b* detect the shorting only during receiving high signal as short detection enable signal EN. In the other word, detection of the shorting is executed only when it is necessary in accordance with instruction from control circuit M100. As a result, avoiding false detection of shorting, detection of the shorting may be executed only when there is really a risk that the shorting may happen. One of the concrete example of the false detection is that the electric potential of contact detection terminals 101, 103 temporarily exceed short detection voltage V_ref1 by potential fluctuation when the ink cartridge 70 is attached or detached.

Furthermore, the control circuit M100 makes short detection enable signal EN high to detect the shorting during driving the sensor driving circuit M20 to detect remaining ink level. Therefore, detection of the shorting is executed at least during the period that the voltage is being outputted from the for-senor terminal 104. As a result, the trouble that the high voltage is accidentally applied to cartridge detection circuits M10*a*, M10*b*, by outputting from the for-senor terminal 104 when the shorting happens, is surely reduced or prevented.

Furthermore, the terminal board 100 on the cartridge holder 62 has two contact detection terminals 101 and 103. On the other hand, there are three types of the circuit board 110 mounted to the ink cartridge 70, i.e. board 110*a*, 110*b*, 110*c* which respectively has detection terminal 116, 117, 118 with different combination of presence or absence of the contact with two contact detection terminals 101 and 103. The printing apparatus 20 detect respectively whether two contact detection terminals 101 and 103 contact with detection terminals 116 to 118 to determine whether the ink cartridge 70 is attached and the type of the attached ink cartridge 70 using result of the detection. As a result, the printing apparatus 20 is capable of executing appropriate process based on determination of whether the ink cartridge 70 is attached and the type of the attached ink cartridge 70.

B. Variations

In the embodiment, the shorting between contact detection terminals 101, 103 and for-senor terminal 104 is concerned with. This embodiment may apply not only to this but to other type of shorting, e.g. when ink cartridge 70 has memory like EEPROM, shorting between the contact detection terminals 101, 103 and a terminal outputting the voltage to ink cartridge 70 for reading/writing the memory.

While size of the ink cartridge is determined in cartridge determination process of above-mentioned embodiment, other factor may be determined as well. For example, in the printing apparatus which can switch high-quality mode and law quality mode, wherein eight cartridges, with each one with a different color (Cyan, Magenta, Yellow, Black, Light Cyan, Light Magenta, Light Yellow and Light Black) are used in high-quality mode, and with each two with different color (Cyan, Magenta, Yellow, Black) are used in law-quality mode, the type of color of ink may be determined. By this, the printing apparatus is automatically capable of determining whether the appropriate ink cartridges 70 are attached on printing in each printing mode.

In above-mentioned embodiment, the printing apparatus 20 has two contact detection terminals 101 and 103, so the printing apparatus 20 can determine three types of ink cartridge 70 and whether ink cartridge 70 is attached using two types of cartridge detection signals CO1, CO2. In variations, the printing apparatus may have more than two contact detection terminals and use more than two types of cartridge detection signals. In this case, the printing apparatus 20 is capable of determining more types of ink cartridge 70 than above-mentioned embodiment.

While this invention applies to the ink cartridge 70 and the printing apparatus 20 to which the ink cartridge 70 is attached in above-mentioned embodiment, this invention may also apply to the container which contain other printing material, for example, toner and printing apparatus to which such container is attached.

While the present invention has been described on the basis of the embodiment and variations, these embodiment and variations of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

The invention claimed is:

1. A printing apparatus to which at least one printing material container is attachable, wherein the printing material container stores printing material and has a detection terminal, the printing apparatus comprising:

a contact detection terminal that contacts to the detection terminal of the printing material container when the printing material container is attached to the printing apparatus;

a contact detection circuit that detects contact or non-contact between the contact detection terminal and the detection terminal of the printing material container using a predetermined level of voltage;

a high voltage output terminal that outputs a high voltage higher than the predetermined level of voltage;

a shorting detector that detects a shorting between the contact detection terminal and the high voltage output terminal; and a high voltage circuit that controls a voltage outputted from the high voltage output terminal, wherein the high voltage circuit reduces or interrupts the voltage outputted from the high voltage output terminal when the shorting is detected.

2. A printing apparatus according to claim 1, wherein the detection of the shorting is executed during the period when the high voltage output terminal is outputting a voltage by control of the high voltage circuit.

3. A printing apparatus according to claim 1, further comprising a controller that outputs detection enable signal allowing to detect the shorting, wherein the detection of the shorting is executed during the period when the detection enable signal is being outputted.

4. A printing apparatus according to claim 3, wherein the detection enable signal is being outputted during the period when the high voltage output terminal is outputting a voltage by control of the high voltage circuit.

5. A printing apparatus according to claim 1, wherein the printing material container further has a sensor for detecting a status of the printing material and a sensor terminal electrically connected to the sensor, the high voltage terminal includes a for-sensor terminal that contacts the sensor terminal when the printing material container is attached to the printing apparatus, and the high voltage circuit includes a sensor driving circuit that drives the sensor via the for-sensor terminal.

6. A printing apparatus according to claim 5, wherein the sensor includes a sensor for detection of a remaining level of the printing material using a piezoelectric element.

7. A printing apparatus according to claim 1 comprising the plural contact detection terminals, wherein the contact detection circuit respectively detects contact or non-contact of each of the plural contact detection terminals to the detection terminal of the printing material container, and the printing apparatus further comprises a container determinator that determines a type of the printing material container using the respectively detected result of the contact between each of the plural contact detection terminals and the detection terminal of the printing material container.

8. A printing apparatus according to claim 7, wherein the container determinator determines the printing material container is not attached to the holder, when all of the plural contact detection terminals have no contact with the detection terminal of the printing material container.

9. A control method of a printing apparatus to which at least one printing material container is attachable, wherein the printing material container stores printing material and has a detection terminal, wherein the printing apparatus has a contact detection terminal that contacts to the detection terminal of the printing material container when the printing material container is attached to the printing apparatus and a high voltage output terminal that outputs a high voltage, the control method comprising:

monitoring a shorting between the high voltage output terminal and the contact detection terminal;

outputting a voltage from the high voltage output terminal while monitoring the shorting; and reducing or interrupting the voltage outputted from the high voltage output terminal when the shorting is detected.

* * * * *